US006772468B1

(12) United States Patent
Psik et al.

(10) Patent No.: US 6,772,468 B1
(45) Date of Patent: Aug. 10, 2004

(54) FLOOR-MOPPING DEVICE

(75) Inventors: Sandra Psik, Laudenbach (DE); Volker Oehlenschläger, Fürth (DE)

(73) Assignee: Firma Carl Freudenburg, Weinheim (DE)

( * ) Notice: Subject to any disclaimer, the term of this patent is extended or adjusted under 35 U.S.C. 154(b) by 0 days.

(21) Appl. No.: 09/306,854

(22) Filed: May 7, 1999

(30) Foreign Application Priority Data

May 8, 1998 (DE) ..... 198 20 538

(51) Int. Cl.[7] ..... A47L 13/20; A47L 13/24
(52) U.S. Cl. ..... 15/229.2; 15/147.1
(58) Field of Search ..... 15/147.1, 147.2, 15/229.1, 229.2, 229.3, 229.4, 229.5

(56) References Cited

U.S. PATENT DOCUMENTS

| | | | |
|---|---|---|---|
| 2,854,683 A | 10/1958 | Warden | |
| 2,884,655 A | 5/1959 | Maddox | |
| 3,006,011 A | 10/1961 | Littleton | |
| 3,016,556 A | 1/1962 | Greenleaf | |
| 3,737,938 A | 6/1973 | Saltzstein | |
| 4,475,262 A | 10/1984 | Downer | |

FOREIGN PATENT DOCUMENTS

| | | | |
|---|---|---|---|
| DE | 1 716 930 | | 2/1956 |
| DE | 2 229 824 | | 1/1973 |
| DE | 32 34 704 | | 3/1984 |
| DE | 91 01 739 | | 4/1992 |
| DE | 297 01 349 | | 6/1997 |
| EP | 0 697 269 | | 2/1996 |
| GB | 200733 | * | 7/1923 |

* cited by examiner

*Primary Examiner*—Randall Chin
(74) *Attorney, Agent, or Firm*—Kenyon & Kenyon

(57) ABSTRACT

A floor-mopping device having a handle which is connected to a supporting body having at least one flexible mopping element suspended from it in pendulum fashion. The supporting body and handle are connected by a swivel joint, and the swivel joint has an axis of rotation extending essentially in a direction parallel to the longitudinal axis of handle.

17 Claims, 3 Drawing Sheets

FLOOR-MOPPING DEVICE

FIELD OF THE INVENTION

The invention relates to a floor-mopping device having a handle which is connected to a supporting body having at least one flexible mopping element suspended from it in pendulum fashion.

BACKGROUND OF THE INVENTION

A floor-mopping device of this kind is described in the German utility model patent 29 701 349. It is used for the wet cleaning of floors, and for this purpose is moved over the surface to be cleaned in a zigzag or loop-shaped path. In the process, the flexible mopping elements always point to the rear, making it necessary to set the entire floor-mopping device into a slewing motion each time a vertex (i.e., the point of maximum excursion)of the zigzag path is reached to prevent the mopping elements from snarling.

SUMMARY OF THE INVENTION

The object of the present invention is to further develop a floor-mopping device of the type indicated at the outset in such a way that, when cleaning a floor surface in a back and forth zigzag movement, it is no longer necessary to set the entire floor-mopping device into a slewing motion each time a vertex is reached.

This objective is achieved according to the present invention in a floor-mopping device of the type having a handle that is connected to a supporting body having at least one flexible mopping element suspended from it in pendulum fashion.

In the floor-mopping device according to the present invention, the supporting body is rotatable about an axis extending in a direction parallel to the longitudinal direction of the handle, and means are provided to suppress canting of the supporting body relative to the handle. As a result, the handle of the floor-mopping device can be grasped firmly by both hands, with optimum body posture, and moved over a surface to be cleaned in a zigzag or looped path without requiring the position of the hand or the posture to change at the vertices of this movement. Nevertheless, the flexible mopping elements suspended from the supporting body in pendulum fashion always show to the rear, thus being continually available for achieving optimum cleaning results, while avoiding the formation of snarls. This is a great advantage for the user of the floor-mopping device. Since at no time during use is it necessary to change the hand or bodily position in an ergonomically unfavorable manner, there is a saving of effort.

The means for suppressing canting of the supporting body can be formed by a columnar or conical guideway. In the simplest case, they can be formed by a sleeve, fixed to the supporting body, into which the cylindrical shaft of the handle is inserted in a manner allowing rotational movement. Not only is such a design cost-effective to produce, it also offers the advantage of particularly high functional reliability when dealing with the great amount of dirt to be expected during normal use. The handle can be affixed in such a sleeve by a clip connection, in which a portion of the one part projecting transversely to the longitudinal axis snaps into a groove of the other part.

Particularly easy slewability of the supporting body relative to the handle can be achieved if the supporting body and the handle are connected by a specially adapted swivel joint.

In particular, the frictional forces occurring during a slewing motion can be considerably reduced by such an embodiment, making it easier to manipulate the floor-mopping device.

The turning range of the supporting body relative to the handle can be limited in at least one direction by providing the handle with a stop which can be forced into engagement with a counterstop of the supporting body. In this manner, undesired deflection movements of the mopping elements can be prevented during certain cleaning processes, for example, when cleaning the floor surface together with a baseboard laterally surrounding it.

In turn, other conditions exist when, for example, both the risers of a staircase and the floor surface are to be cleaned in one operation. To more easily be able to adapt the floor-mopping device to such frequently changing requirements, it has proven to be advantageous for the stop and/or the counterstop to be adjustable in the circumferential direction, or to be completely disengageable or removable as needed.

The swivel joint can be formed by a sleeve, fixed to the handle or the supporting body, which surrounds a journal of the supporting body or of the handle in at least one partial area. At the same time, the journal and/or the handle can be hollow to reduce the total weight.

It has proven to be advantageous if the handle is able to be brought closer to the supporting body against the force of a spring, such an approach permitting a releasable anti-rotation element to be engaged or actuated, the anti-rotation element being arranged between the sleeve and the journal, and temporarily suppressing the slewing capacity. Such a requirement may exist, for example, if one only wishes to suppress rotation of the supporting body relative to the handle during forward movements of the floor-mopping device, while allowing rotation during all other movements. For example, surface areas underneath cabinets or projections, which are difficult to access, can thus be reached more easily with the mopping elements. In contrast, when withdrawing the floor-mopping device, the anti-rotation element is automatically put out of operation, allowing the supporting body and the mopping elements to optimally align again with the surface to be cleaned. The anti-rotation element engages and disengages automatically. In this respect, its availability represents a great help during normal use of the floor-mopping device.

For marketing reasons, it is sometimes desirable to be able to offer the parts of the floor-mopping device which are subject to wear and tear, independently of the other parts. From this standpoint, it has proven to be advantageous if the swivel joint forms a component of the handle and is detachably secured to the supporting body.

If, as a result of the dirt load to be expected during normal use, the relative moveability in the region of the swivel joint may be impaired, it is possible to replace it, along with the supporting body and the mopping elements, as needed. In such cases, the swivel joint should form a component of the supporting body and be detachably secured to the handle.

The swivel joint can also be composed of two relatively twistable components, separable from each other, which, on one hand, are secured to the supporting body and, on the other hand, to the handle. This offers the possibility of not only cleaning the functional parts of the swivel joint after separating them, thus eliminating impairment of functioning caused by dirt, but also of replacing one of the functional parts with a new one when replacing the supporting body including the attached mopping elements. Thus, it is possible to satisfy the user's interest in always having available an inexpensive floor-mopping device, characterized by particularly high functional reliability.

If desired, it is, of course, also possible to use a swivel joint which is contained in an adapter that can be detachably secured both to the supporting body and to the handle. In such an embodiment, the different functions of the swivel joint can be optimized without having to expect any disturbing wear and tear over a foreseeable period of time. Therefore, such an embodiment is particularly preferred for professional applications.

DETAILED DESCRIPTION

Figure 1:
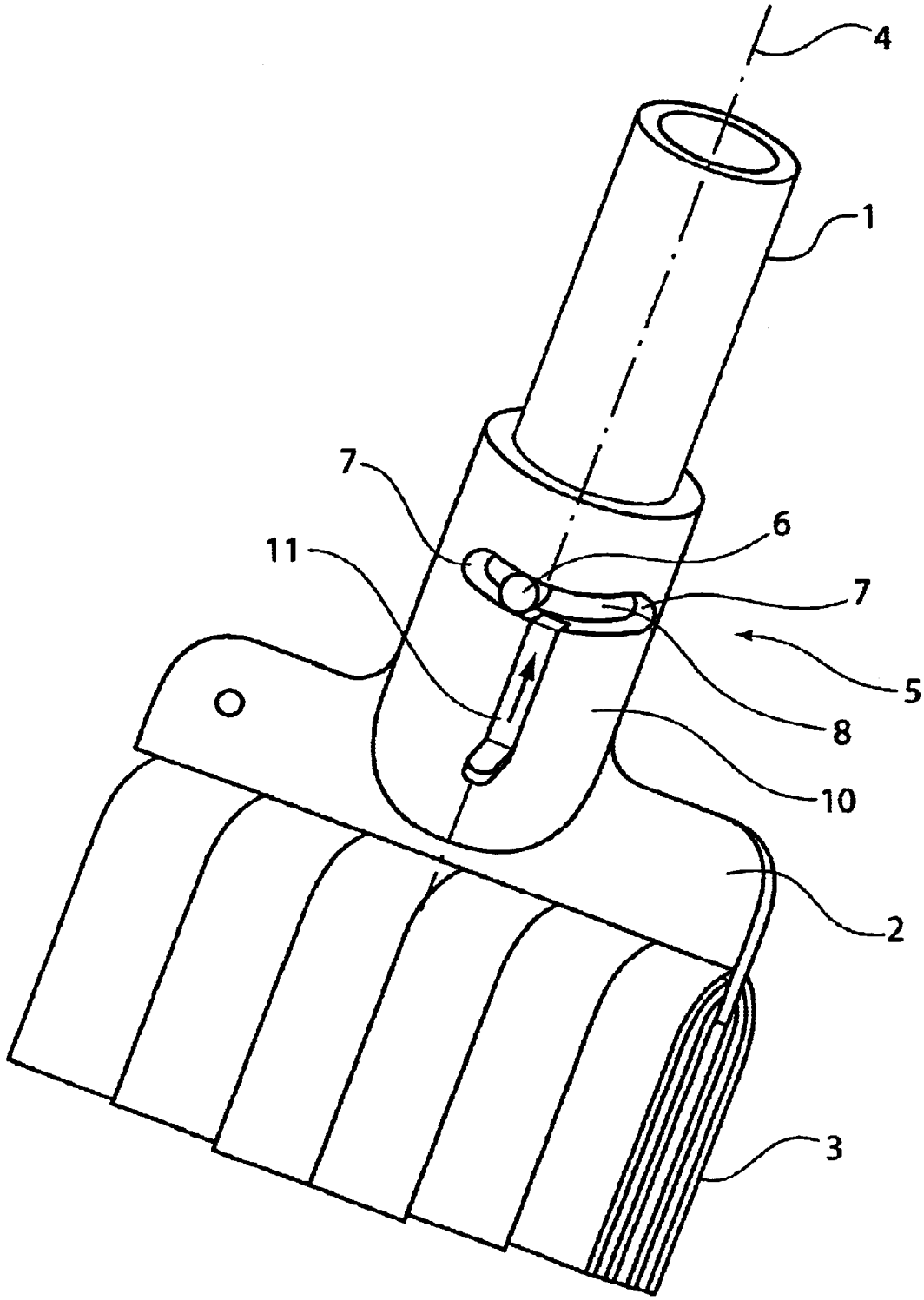
FIG. 1 provides a perspective view from above of a portion of a floor-mopping device constructed according to the principles of the invention.
Figure 2:
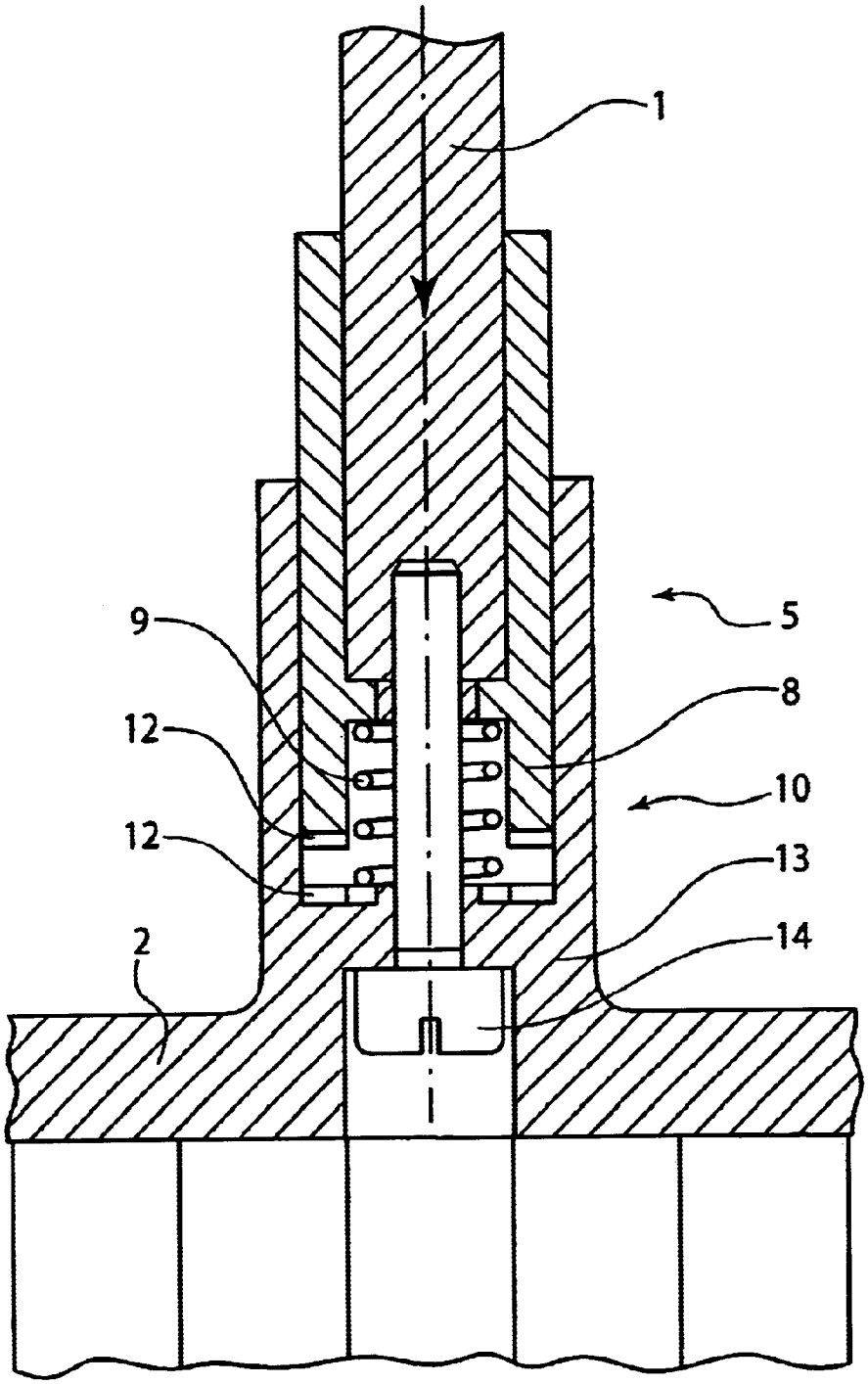
FIG. 2 shows an alternative embodiment of a section of a floor-mopping device constructed according to the principles of the invention, shown in longitudinal section.

The floor-mopping device shown in FIGS. 1 and 2 includes a handle 1 which is connected to a supporting body 2 having a plurality of flexible mopping elements 3 suspended from it in pendulum fashion. Mopping elements 3 can be made of yarn hanks, of foamed-plastic or textile strips, for example, strips of nonwoven fabric. Furthermore, to improve the cleaning effect, they can be provided with a finish such as a print pattern made of an elastic polymeric material projecting above the surface.

Supporting body 2 is rotatable about an axis 4 which coincides with the longitudinal axis of handle 1. Handle 1 is cylindrical and is supported at its lower end in a hollow cylindrical columnar guideway of supporting body 2. This makes it impossible for supporting body 2 to cant relative to handle 1.

Nevertheless, a swivel joint 5 is provided between supporting body 2 and handle 1, allowing slight relative twisting capacity. In this context, the relative twisting capacity of handle 1 is limited in both directions by a stop 6 which can be forced into engagement with counterstops 7 of supporting body 2. This makes it possible to prevent undesired relative twisting of supporting body 2 when cleaning surfaces that are difficult to access, such as the risers of a staircase.

Furthermore, there is the possibility of designing stop 6 so that it can be deflected by a spring into handle 1, enabling handle 1 to be removed from swivel joint 5 and cleaned in the area of its lower end as needed. This represents a significant advantage in ensuring good relative moveability over long periods of time.

At least one of counterstops 7 can be adjustable for limiting or suppressing the moveability of handle 1 relative to supporting body 2, and can be replaced by other equally acting means as needed. For example, inserted for this purpose in a section 10 of swivel joint 5 is a slider 11 which can be brought manually into the path of stop 6. In this manner, the relative twisting capacity of handle 1 is limited. The placement of slider 11 is left to the discretion of the manufacturer of the floor-mopping device and can be determined as required with a view to performing specific cleaning processes.

In the embodiment shown in FIG. 2, handle 1 can be brought closer to supporting body 2 against the force of a spring 9, permitting a releasable anti-rotation element 10 to engage. Anti-rotation element 10 is essentially composed of mutually-facing, front-side toothings 12 of, on the one hand, sleeve 13 forming a component of supporting body 2, and, on the other hand, of journal 8 which either is movable along with handle 1 or forms a component of handle 1. When compressing spring 9, toothings 12 on both sides are forced into engagement with each other, preventing continuing capacity for relative rotation and displacement. The anti-rotation element is only effective as long as handle 1 is being shifted in the direction of supporting body 2 on the path stretches available between toothings 12 on both sides. This may be the case during a forward movement of the floor-mopping device. On the other hand, in an opposite moving direction, spring 9 causes a reverse relative shift in direction of handle 1 in sleeve 13, resulting in the disengagement of anti-rotation element 10. Handle 1 can then be rotated freely again relative to supporting body 2.

In the exemplary embodiment according to FIG. 2, supporting body 2 is connected to handle 1 by a locking screw 14 in a manner allowing relative rotation and displacement. Alternatively, it is conceivable to use a clip connection or the like.

Figure 3:
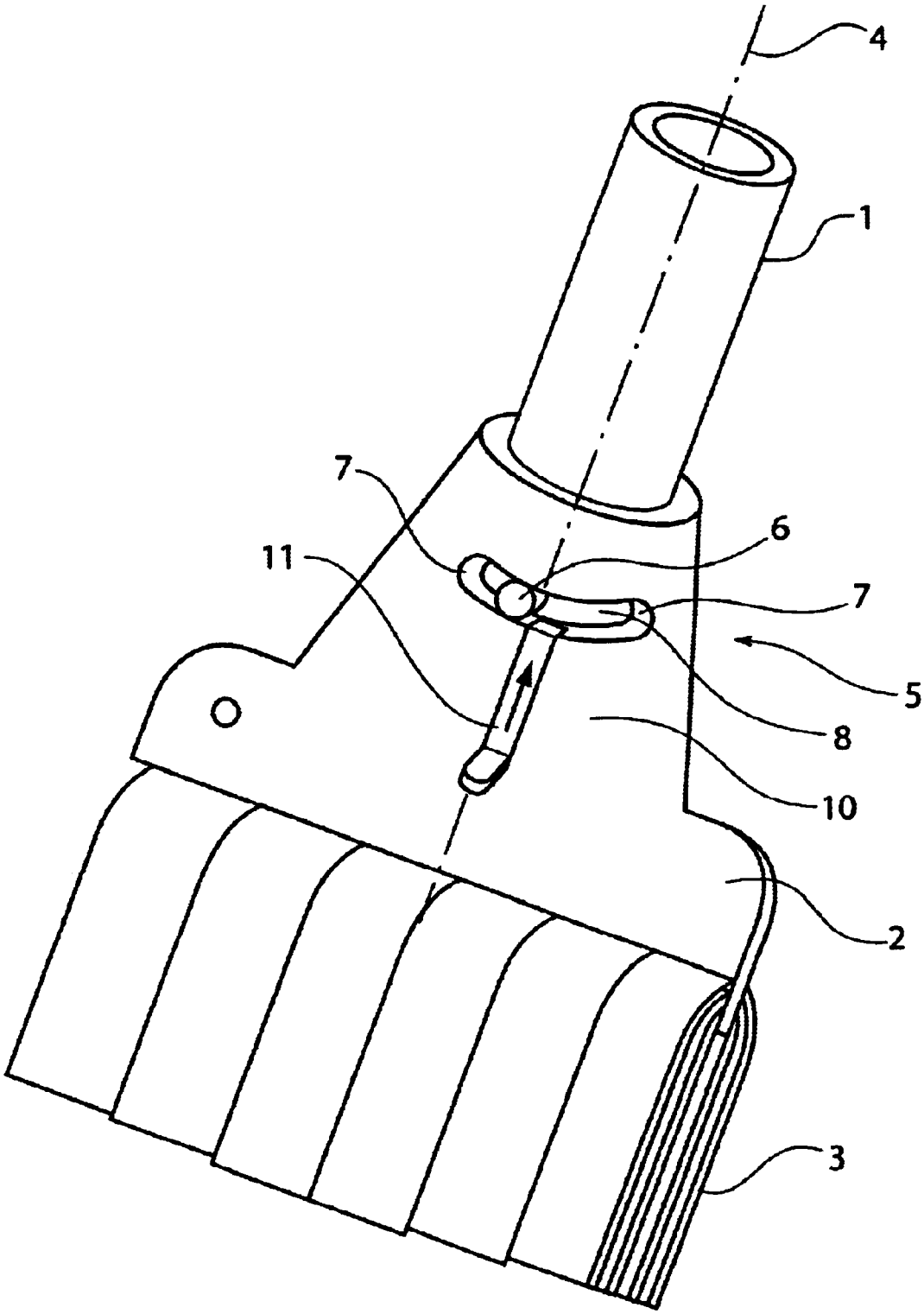
FIG. 3 shows a conical guideway of the supporting body.

As illustrated in FIG. 3, the supporting body 2 may have a guideway that is conical in configuration.

What is claimed is:

1. A floor-mopping device, comprising:

a handle having a longitudinal axis;

a supporting body to which the handle is connected, the supporting body being rotatable about the longitudinal axis of the handle;

at least one flexible mopping element suspended from the supporting body in pendulum fashion; and means for suppressing canting of the supporting body relative to the handle, wherein the means for suppressing canting of the supporting body relative to the handle includes at least one of a counterstop and a handlestop.

2. The floor-mopping device as recited in claim 1, wherein the means for suppressing canting of the supporting body comprise a one of a columnar and conical guideway.

3. The floor-mopping device as recited in claim 1, wherein the supporting body and the handle are connected by a swivel joint.

4. The floor-mopping device as recited in claim 3, wherein the swivel joint comprises two relatively twistable components which are secured to the supporting body and to the handle, and which are separable from each other.

5. The floor-mopping device as recited in claim 3, wherein the swivel joint is contained in an adapter which is releasably connectible both to the supporting body and to the handle.

6. A floor-mopping device, comprising:

a handle having a longitudinal axis;

a supporting body to which the handle is connected the supporting body being rotatable about the longitudinal axis of the handle;

at least one flexible mopping element suspended from the supporting body in pendulum fashion; and means for suppressing canting of the supporting body relative to the handle;

a counterstop; and a handlestop, wherein the handle has a turning range that is limited in at least one direction by the handle stop which can be forced into engagement with the counterstop located on the supporting body.

7. A floor-mopping device, comprising:

a handle having a longitudinal axis;

a supporting body to which the handle is connected the supporting body being rotatable about the longitudinal axis of the handle;

at least one flexible mopping element suspended from the supporting body in pendulum fashion; and means for suppressing canting of the supporting body relative to the handle, wherein the means for suppressing canting of the supporting body comprise a one of a columnar and conical guideway;

a counterstop; and a handlestop, wherein the handle has a turning range that is limited in at least one direction by the handle stop which can be forced into engagement with the counterstop located on the supporting body.

8. A floor-mopping device, comprising:

a handle having a longitudinal axis;

a supporting body to which the handle is connected the supporting body being rotatable about the longitudinal axis of the handle;

at least one flexible mopping element suspended from the supporting body in pendulum fashion; and means for suppressing canting of the supporting body relative to the handle, wherein the means for suppressing canting of the supporting body comprise a one of a columnar and conical guideway, wherein the supporting body and the handle are connected by a swivel joint;

a counterstop; and a handlestop, wherein the handle has a turning range that is limited in at least one direction by the handle stop which can be forced into engagement with the counterstop located on the supporting body.

9. The floor-mopping device as recited in claim 8, wherein at least one of the stop and the counterstop are adjustable in the circumferential direction.

10. The floor-mopping device as recited in claim 9, wherein at least one of the stop and the counterstop are disengageable.

11. The floor-mopping device as recited in 8, further comprising:

a journal, wherein the swivel joint comprises a sleeve, affixed to one of the handle and the supporting body, which surrounds one of the journal of the supporting body and the handle.

12. The floor-mopping device as recited in claim 11, wherein the journal is hollow.

13. The floor-mopping device as recited in claim 12, wherein the handle can be brought closer to the supporting body against the force of a spring, wherein such movement permits the actuation of a releasable anti-rotation element arranged between the sleeve and the journal.

14. The floor-mopping device as recited in claim 11, wherein the handle can be brought closer to the supporting body against the force of a spring, wherein such movement permits the actuation of a releasable anti-rotation element arranged between the sleeve and the journal.

15. The floor-mopping device as recited in claim 11, wherein the swivel joint forms a component of the supporting body, and is detachably secured to the handle.

16. A floor-mopping device, comprising:

a handle having a longitudinal axis;

a supporting body to which the handle is connected, the supporting body being rotatable about the longitudinal axis of the handle;

at least one flexible mopping element suspended from the supporting body in pendulum fashion; and means for suppressing canting of the supporting body relative to the handle wherein the means for suppressing canting of the supporting body comprise a one of a columnar and conical guideway, wherein the supporting body and the handle are connected by a swivel joint; and a journal, wherein the swivel joint comprises a sleeve, affixed to one of the handle and the supporting body, which surrounds one of the journal of the supporting body and the handle.

17. A floor-mopping device, comprising:

a handle having a longitudinal axis;

a supporting body to which the handle is connected, the supporting body being rotatable about the longitudinal axis of the handle;

at least one flexible mopping element suspended from the supporting body in pendulum fashion; and an arrangement for suppressing canting of the supporting body relative to the handle wherein the supporting body and the handle are connected by a swivel joint and the swivel joint forms a component of the handle, and is detachably secured to the supporting body.

* * * * *